US008485639B2

(12) United States Patent
Lee et al.

(10) Patent No.: US 8,485,639 B2
(45) Date of Patent: Jul. 16, 2013

(54) INKJET PRINT HEAD AND METHOD FOR MANUFACTURING THE SAME

(75) Inventors: Jae Chang Lee, Gyunggi-do (KR); Hwa Sun Lee, Gyunggi-do (KR); Tae Kyung Lee, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 78 days.

(21) Appl. No.: 12/929,638

(22) Filed: Feb. 4, 2011

(65) Prior Publication Data

US 2012/0019596 A1 Jan. 26, 2012

(30) Foreign Application Priority Data

Jul. 21, 2010 (KR) ..... 10-2010-0070513

(51) Int. Cl.
*B41J 2/135* (2006.01)

(52) U.S. Cl.
USPC ..... 347/44; 347/68; 347/70; 347/71; 29/890.1

(58) Field of Classification Search
None
See application file for complete search history.

(56) References Cited

U.S. PATENT DOCUMENTS

| | | | | |
|---|---|---|---|---|
| 6,554,408 | B1 * | 4/2003 | Miki et al. | 347/70 |
| 6,594,898 | B1 | 7/2003 | Yun | |
| 7,963,640 | B2 * | 6/2011 | Tokunaga et al. | 347/71 |
| 2006/0181580 | A1 * | 8/2006 | Lee et al. | 347/68 |
| 2007/0171260 | A1 * | 7/2007 | Lee et al. | 347/71 |
| 2008/0211871 | A1 | 9/2008 | Sakurai et al. | |
| 2010/0167433 | A1 | 7/2010 | Lee et al. | |

FOREIGN PATENT DOCUMENTS

| | | |
|---|---|---|
| KR | 10-0374601 | 3/2003 |
| KR | 10-2007-0078201 | 7/2007 |
| KR | 2008-155591 | 7/2008 |
| KR | 10-2008-0073129 | 8/2008 |

OTHER PUBLICATIONS

Korean Office Action dated Mar. 2, 2012 issued in corresponding Korean Patent Application No. 10-2010-0070513.

* cited by examiner

*Primary Examiner* — Matthew Luu
*Assistant Examiner* — John P Zimmermann

(57) ABSTRACT

An inkjet print head and a method for manufacturing the same are provided. The inkjet print head includes: an upper board having a pressure chamber; and a lower board including an upper silicon layer, an insulating layer, and a lower silicon layer, wherein the lower board includes a projection formed of the upper silicon layer and protruded into the interior of the pressure chamber in order to reduce the space of the pressure chamber, and a lower surface of the upper board and an upper surface of the lower silicon layer are fixed.

19 Claims, 8 Drawing Sheets

INKJET PRINT HEAD AND METHOD FOR MANUFACTURING THE SAME

CROSS-REFERENCE TO RELATED APPLICATIONS

This application claims the priority of Korean Patent Application No. 10-2010-0070513 filed on Jul. 21, 2010, in the Korean Intellectual Property Office, the disclosure of which is incorporated herein by reference.

BACKGROUND OF THE INVENTION

1. Field of the Invention

The present invention relates to an inkjet print head and a method for manufacturing the same, and more particularly, to an inkjet print head that can be driven at a low driving voltage by having a projection formed to reduce the space of a pressure chamber and manufactured through a simpler process by forming the projection on an upper silicon layer of a lower board formed of a silicon on insulator (SOI) wafer, and a method for manufacturing the same.

2. Description of the Related Art

In general, an inkjet print head is a structure that converts an electrical signal into a physical force so that ink is ejected in droplets through a small nozzle.

The inkjet print head may be divided into various types of heads depending on how ink is ejected. In particular, recently, a piezoelectric inkjet print head ejecting ink by using piezoelectricity has been extensively used in the industrial inkjet printers.

For example, the piezoelectric inject print head directly jets ink produced by melting a metal such as gold, silver, or the like, onto a flexible printed circuit board (FPCB) to directly form a circuit pattern, is used for industrial graphics or to manufacture a liquid crystal display (LCD), an organic light emitting diode (OLED), or is used to produce a solar cell, and the like.

The viscosity of industrial ink is higher than general OA ink, so in order for the piezoelectric inkjet print head to eject ink in droplets with a desired volume at a desired speed, the piezoelectric inject print head is required to have a high driving voltage.

SUMMARY OF THE INVENTION

An aspect of the present invention provides an inkjet print head capable of ejecting ink in droplets at a desired speed or volume at a low driving voltage by having a projection formed to reduce the space of a pressure chamber, and a method for manufacturing the same.

Another aspect of the present invention provides an inkjet print head capable of simplifying a manufacturing process by forming the projection on an upper silicon layer of a lower board formed of an SOI wafer, and a method for manufacturing the same.

According to an aspect of the present invention, there is provided an inkjet print head including: an upper board having a pressure chamber; and a lower board including an upper silicon layer, an insulating layer, and a lower silicon layer, wherein the lower board includes a projection formed of the upper silicon layer and protruded into the interior of the pressure chamber in order to reduce the space of the pressure chamber, and a lower surface of the upper board and an upper surface of the lower silicon layer are fixed.

The upper board may be formed of a silicon on insulator (SOI) wafer including a first silicon layer, an intermediate oxide film, and a second silicon layer which are sequentially stacked. The projection may be formed to have a height less than the thickness of the first silicon layer.

The lower board may include: a manifold supplying ink, being introduced from an ink inlet, to the pressure chamber, and a damper formed between the pressure chamber and a nozzle. In this case, the side of at least one of the manifold and the damper may be sloped or perpendicular to a lower surface.

A restrictor may be formed between the manifold and the pressure chamber in order to prevent ink inside the pressure chamber from flowing backward into the manifold, and in this case, the restrictor may be formed by the side of the projection near the manifold and by the side of the pressure chamber near the manifold.

The insulating layer may be formed of an oxide film formed by oxidizing the surface of the lower silicon layer.

According to another aspect of the present invention, there is provided a method for manufacturing an inkjet print head, including: forming a pressure chamber recess on an upper board, preparing a lower board by sequentially stacking a lower silicon layer, an insulating layer, and an upper silicon layer, removing portions of the upper silicon layer other than a portion for forming a projection to be disposed within the pressure chamber recess, and fixing a lower surface of the upper board and an insulating layer of the lower board such that the projection is disposed in a space of the pressure chamber recess.

The fixing of the lower surface of the upper board and the insulating layer of the lower board may be performed through silicon direct bonding (SDB).

The method may further include: etching the lower board in order to form a manifold supplying ink, being introduced through an ink inlet, to the pressure chamber and a damper, an ink flow path, between the pressure chamber and a nozzle. In this case, the etching of the lower board to form the manifold and the damper may be performed through reactive ion etching (RIE).

In etching the lower board, the lower board may be etched such that the side of at least one of the manifold and the damper is sloped.

The removing of the portions of the upper silicon layer other than the portion for forming the projection may be performed through RIE using inductively coupled plasma (ICP).

The removing of the portions of the upper silicon layer other than the portion for forming the projection may be performed through a wet etching method using tetramethyl ammonium hydroxide (TMAH) or potassium hydroxide (KOH).

The removing of the portions of the upper silicon layer other than the portion for forming the projection may be performed by using the insulating layer as an etching stopper layer.

The upper board may be formed of an SOI wafer, and the forming of the pressure chamber recess on the upper board may be performed by using an intermediate oxide film of the SOI wafer as an etching stopper layer.

The preparing of the lower board may include etching the lower silicon layer such that a manifold supplying ink, being introduced through the ink inlet, to the pressure chamber and a damper, an ink flow path, between the pressure chamber and the nozzle are formed; forming the insulating layer on an upper surface of the lower silicon layer; and stacking the upper silicon layer on the insulating layer.

In the forming of the insulating layer, the insulating layer may be formed by oxidizing the surface of the lower silicon layer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
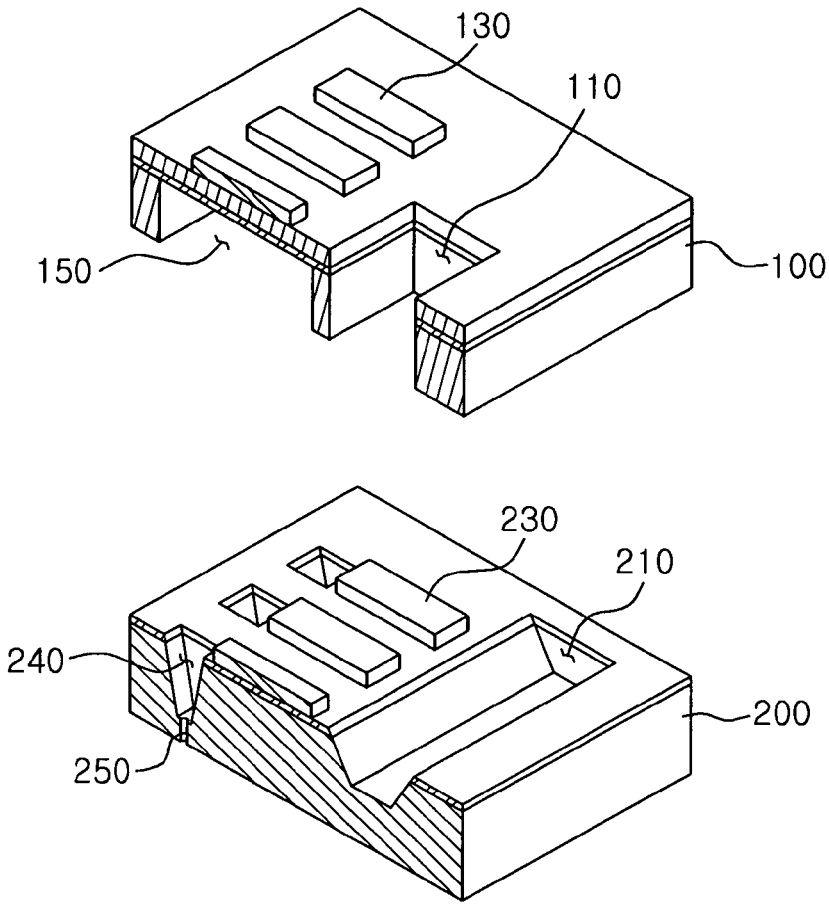
FIG. 1 is an exploded perspective view showing a partially cut inkjet print head according to a first exemplary embodiment of the present invention.

Exemplary embodiments of the present invention will now be described in detail with reference to the accompanying drawings. The invention may however be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions may be exaggerated for clarity, and the same reference numerals will be used throughout to designate the same or like components.

Figure 2:
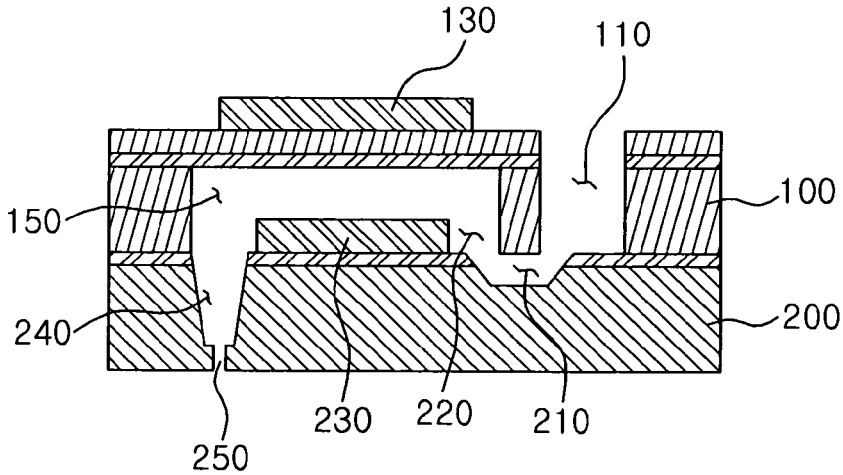
FIG. 2 is a vertical sectional view of the inkjet print head according to the first exemplary embodiment of the present invention.

FIG. 1 is an exploded perspective view showing a partially cut inkjet print head according to a first exemplary embodiment of the present invention. FIG. 2 is a vertical sectional view of the inkjet print head according to the first exemplary embodiment of the present invention. FIGS. 3*a* to 3*d* show the sequential process of a method for forming an ink flow path in an upper board of the inkjet print head according to the first exemplary embodiment of the present invention. FIGS. 4*a* to 4*g* show a sequential process of a method for forming an ink flow path in a lower board of the inkjet print head according to the first exemplary embodiment of the present invention.

With reference to FIGS. 1 to 4, an inkjet print head according to a first exemplary embodiment of the present invention includes an upper board 100, a lower board 200, and piezoelectric actuators 130 formed on an upper surface of the upper board 100.

An ink inlet 100, through which ink is introduced, and a plurality of pressure chambers 150, may be formed on the upper board 100. The upper board 100 may be a single crystalline silicon board or may be a silicon on insulator (SOI) wafer including an insulating layer formed between two silicon layers. When the upper board 100 is an SOI wafer, the height of the pressure chamber 150 may be substantially equivalent to the thickness of a lower silicon layer among two silicon layers of the SOI wafer.

The piezoelectric actuators 130 are formed on the upper board 100 such that they correspond to the pressure chamber 150, and provide a driving force (or power) to the pressure chamber 150 to enable the pressure chamber 150 to eject the ink, which has been introduced into the pressure chambers 150, through a nozzle 250. For example, the piezoelectric actuators 130 may be configured to include a lower electrode serving as a common electrode, a piezoelectric film transformed according to voltage applied thereto, and an upper electrode serving as a driving electrode.

The lower electrode may be formed on the entire surface of the upper board 100. Preferably, the lower electrode is configured to include two metal thin film layers made of titanium (Ti) and platinum (Pt). The lower electrode serves as a diffusion prevention layer for preventing interdiffusion between the piezoelectric film and the upper board 100 as well as serving as a common electrode. The piezoelectric film is formed on the lower electrode and disposed at respective upper portions of the plurality of chambers 150. The piezoelectric film may be formed of a piezoelectric material, and preferably, of a lead zirconate titanate (PZT) ceramic material. The upper electrode is formed on the piezoelectric film and may be made of any one of Pt, Au, Ag, Ni, Ti and Cu. In this case, the upper electrode may be formed by screen-printing PZT paste and screen-printing Ag/Pd paste, and then sintering them together.

In the present exemplary embodiment, ink is ejected by using a piezoelectric driving method using the piezoelectric actuators 130. However, the ink ejection method of the present invention is not limited thereto. Ink ejection can be performed by using various kinds of methods including a thermal driving method according to conditions being required.

The lower board 200 may include a manifold that transfers the ink, being introduced through the ink inlet 110, to the plurality of pressure chambers 150, a plurality of nozzles 250 through which the ink is ejected, and a damper 240 formed between the pressure chamber 150 and the nozzle 250. The manifold 210 and the damper 240 may be formed such that the side thereof is sloped and a horizontal section thereof diminishes toward a lower portion thereof, respectively. Here, the horizontal section refers to a section parallel to an installation surface of the inkjet print head.

The lower board 200 may be formed of a single crystalline silicon board or SOI wafer. Preferably, the lower board 200 may be SOI wafer configured by sequentially stacking a lower silicon layer 201, an insulating layer 202, and an upper silicon layer 203. This is because, if the single crystalline silicon board is used, when portions, excluding the projection, are etched in a wet or dry manner, a surface roughness of the silicon board required for silicon direct bonding (SDB) with the upper board cannot be obtained.

The manifold 210 and the damper 240 may be formed at a portion of the lower silicon layer 201 and the insulating layer 202, and the nozzle 250 may be formed at a portion of the lower silicon layer 201. Also, the projection 230, to be disposed in the space of the pressure chamber 150, may be formed on the upper silicon layer 203.

The projection 230 may have a horizontal section in a rectangular shape; however, this is merely illustrative, and the projection 230 may have various other shapes, such as a parallelogram or a hexagon, so long as it can be insertedly position within the pressure chamber. Also, the projection 230 may be designed to have various heights according to required design conditions within a limitation in which it can be disposed within the space of the pressure chamber 150. For example, the projection 230 may be formed to have substantially the same thickness as that of the upper silicon layer 203, and have a thickness ranging from 10 μm to 100 μm depending on the height of the pressure chamber 150 as required. In this case, the height of the projection 230 may be 100 μm or greater if there is no problem with patterning in relation to other ink flow paths configurations.

A plurality of restrictors 220 may be formed between the manifolds 210 and the pressure chambers 150 in order to prevent the ink inside the pressure chambers from flowing backward into the manifolds 210 when the ink is being ejected. In detail, the restrictor 220 may be formed by the side of the pressure chamber 150 near the manifold 210 and by the side of the projection 230 near the manifold 210.

Hereafter, an inkjet print head configured as described above according to the first exemplary embodiment will be described.

First, a manufacturing method according to a preferred embodiment of the invention will be described in brief. Ink flow paths are formed on the upper board and the lower board. The upper board is stacked on the lower board and bonded to each other, thus completing the inkjet print head according to the present exemplary embodiment. Meanwhile, the processes of forming the ink flow paths in the upper board and the lower board may be performed regardless of order. That is, the ink flow paths may be formed in the upper board first and then the lower board, or vice versa. Alternatively, the ink flow paths may be formed in the upper board and the lower board at the same time. However, for the convenience of explanation, the process of forming the ink flow paths in the upper board will be described first.

Figure 3A:
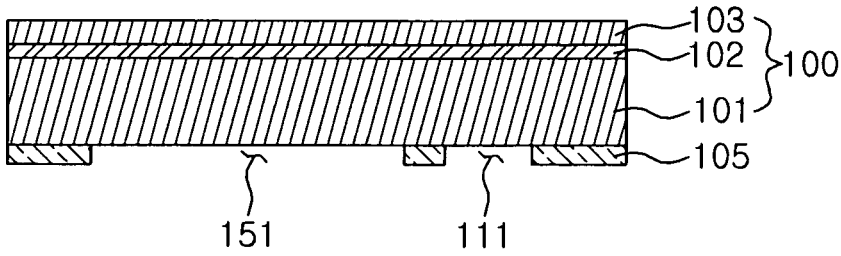
FIGS. 3*a* to 3*d* show the sequential process of a method for forming an ink flow path in an upper board of the inkjet print head according to the first exemplary embodiment of the present invention.

With reference to FIG. 3*a*, in the present exemplary embodiment, SOI wafer including a first silicon layer 101 having a thickness ranging from 100 μm to 200 μm, an intermediate oxide film 102 having a thickness ranging from 0.3 μm to 2 μm, and a second silicon layer 103 having a thickness ranging from 5 μm to 13 μm is employed as the upper board 100. The prepared upper board 100 is wet-oxidized and/or dry-oxidized to form a silicon oxide film having a thickness ranging from 5,000 Å to 15,000 Å on upper and lower surfaces of the upper board 100.

A photoresist 105 is applied to the lower surface of the upper board 100, and the applied photoresist 105 is patterned to form a first opening 111 for forming the ink inlet 110 and a second opening 151 for forming the pressure chamber 150. In this case, the photoresist 105 may be patterned through well-known photolithography including exposure and development processes, and other photoresists to be described hereinafter may be also patterned in the same manner.

Figure 3B:
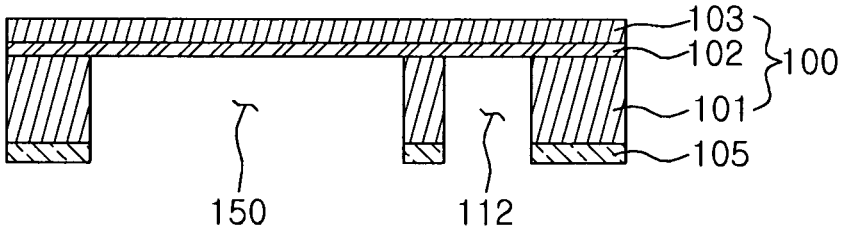

Next, as shown in FIG. 3*b*, portions of the first silicon layer 101 exposed through the first and second openings 111 and 151 are etched by using the patterned photoresist 105 as an etching mask to form a first recess 112, part of the ink inlet 110, and the recess of the pressure chamber 150. In this case, the first silicon layer 101 of the upper board 100 is etched by using a dry etching method such as reactive ion etching (RIE) using inductively coupled plasma (ICP), but it may be also etched by using a wet etching method using a silicon etchant, for example, tetramethyl ammonium hydroxide (TMAH) or potassium hydroxide (KOH). The etching method of the silicon layer may be applied in the same manner in etching other silicon layers to be described hereinafter.

When the first silicon layer 101 is etched to form the recess of the pressure chamber 150, the intermediate oxide film 102 serves as an etching stopper layer, so the height of the recess of the pressure chamber 150 may be substantially the same as the thickness of the first silicon layer 101.

Figure 3C:
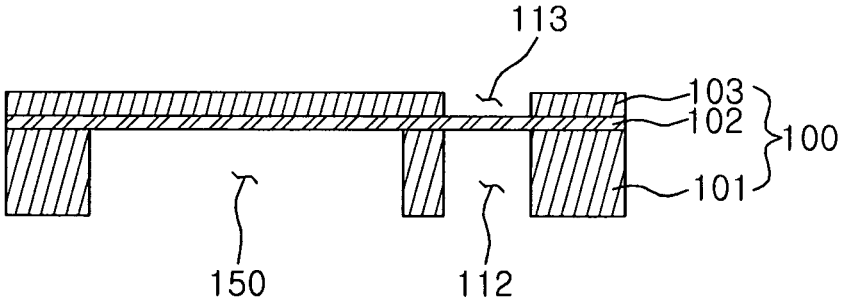

And then, as shown in FIG. 3*c*, the second silicon layer 103 is etched to form a second recess 113, part of the ink inlet 110. In this case, a photoresist may be applied to the upper surface of the second silicon layer 103 and patterned to form an opening for forming the ink inlet 110, and the portion of the second silicon layer 103 exposed through the opening may be then etched by using the patterned photoresist as an etching mask to form the second recess 113.

Figure 3D:
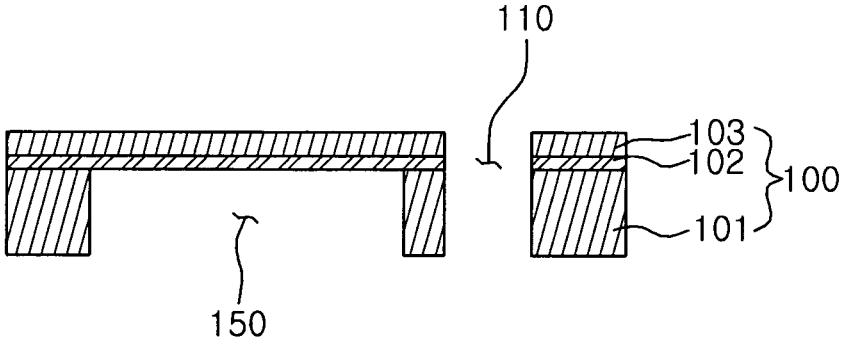

Thereafter, as shown in FIG. 3*d*, the portion of the intermediate oxide film 102 where the ink inlet 110 is to be formed is etched to allow the first recess 112 and the second recess 113 to communicate with each other, thus forming the ink inlet 110. In this case, the intermediate oxide film 102 may be a silicon oxide film formed by oxidizing the surface of the first silicon layer 101, and the intermediate oxide film 102 may be etched by using a dry etching method such as the RIE or a wet etching method using a buffered oxide etchant (BOE). The etching method of the intermediate oxide film may be applied in the same manner in etching other intermediate oxide films or insulating layers to be described hereinafter.

In the above description, the ink flow path is formed by using the SOI wafer as the upper board 100, but the present invention is not limited thereto and a single crystalline silicon board may also be used as the upper board 100. Namely, a single crystalline silicon board having a thickness ranging from 100 μm to 200 μm may be prepared, and the ink inlet 100 and the pressure chamber 150 may be then formed on the upper board 100 in the same manner as illustrated in FIGS. 3*a* to 3*d*.

A process of forming an ink flow path in the lower board of the inkjet print head according to the first exemplary embodiment of the present invention will now be described with reference to FIG. 4.

Figure 4A:
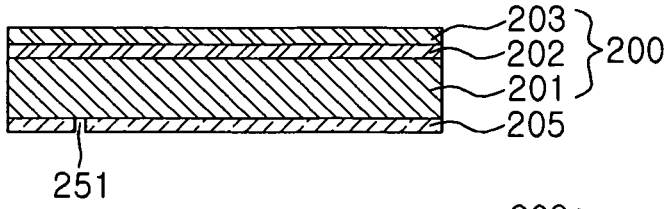
FIGS. 4*a* to 4*g* show a sequential process of a method for forming an ink flow path in a lower board of the inkjet print head according to the first exemplary embodiment of the present invention.

As shown in FIG. 4*a*, SOI wafer including a lower silicon layer 201 having a thickness of approximately hundreds of μm, preferably, having a thickness of approximately 210 μm, an insulating layer 202 having a thickness ranging from 1 μm to 2 μm, and an upper silicon layer 203 having a thickness ranging from 10 μm to 100 μm is employed as the lower board 200. The prepared lower board 200 is wet-oxidized and/or dry-oxidized to form a silicon oxide film having a thickness ranging from 5,000 Å to 15,000 Å on upper and lower surfaces of the lower board 200.

A photoresist 205 is applied to the lower surface of the lower board 200, and the applied photoresist 205 is patterned to form an opening 251 for forming the nozzle 250. In this case, the photoresist 205 may be patterned through the photolithography as described above.

Figure 4B:
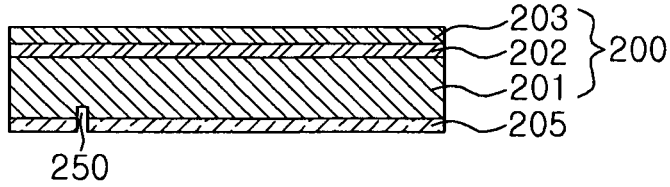

Next, as shown in FIG. 4*b*, a portion of the lower silicon layer 201 exposed through the opening 251 is etched by using the patterned photoresist 205 as an etching mask to form the nozzle 250.

Figure 4C:
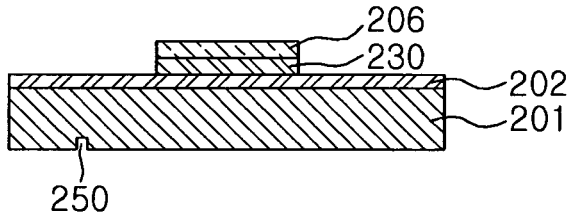

And then, as shown in FIG. 4*c*, a photoresist 206 is applied to an upper surface of the upper silicon layer 203, and portions, excluding a portion for forming the projection 230, of the photoresist 206 are removed, and the exposed portion of the upper silicon layer 203 is etched by using the photoresist 206 as an etching mask to form the projection 230. In this case, the upper silicon layer 203 for forming the projection 230 is etched through a wet etching method using TMAH or KOH or a dry etching method such as RIE using ICP.

The horizontal section of the projection 230 may have a rectangular or a parallelogram shape. The projection having the rectangular section may be obtained by dry-etching the upper silicon layer 203 and the projection 230 having a parallelogram section may be obtained by wet-etching the upper silicon layer 203. Besides, the projection 230 may have various other shapes such as a hexagonal shape of which two facing sides are long, an inverse pyramidal shape, an oval shape, and the like. In this manner, the projection 230 may be formed through dry etching or wet etching, and in particular, a desired shape of projection can be obtained through the dry etching, for example, DRIE, and the like. Because the projection 230 is formed by etching the upper silicon layer 203, it has substantially the same height as the thickness of the upper silicon layer 203, and the height of the projection 230 may be variably adjusted by adjusting the thickness of the upper silicon layer 203. Of course, the height of the pressure chamber 150 may be adjusted according to the height of the projection 230 adjusted thusly.

The photoresist 206 present on the upper surface of the projection 230 may be removed through wet etching or dry etching, or may be removed through chemical mechanical planarization (CMP). In this case, a portion of the thickness of the projection 230 may be also removed to adjust the height of the projection 230.

Figure 4D:
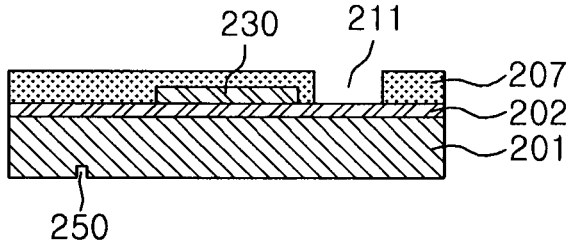

Thereafter, as shown in FIG. 4*d*, a photoresist 207 is applied to cover the upper surface of the lower board 200 with the projection 230 formed thereon, namely, to cover the upper surface of the insulating layer 202 and the upper surface of the projection 230 and patterned to form the opening 211 for forming the manifold 210.

Figure 4E:
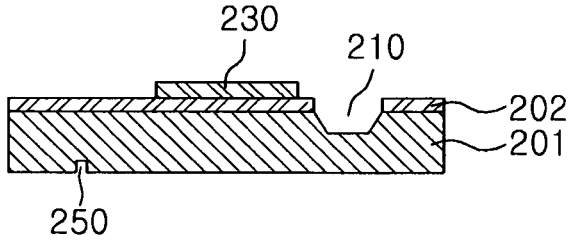

And then, as shown in FIG. 4*e*, portions of the insulating layer 202 and the lower silicon layer 201 are etched by using the patterned photoresist 207 as an etching mask to form the manifold 210. The manifold 210 may be formed through a dry etching method or a wet etching method, and in particular, the manifold 210 may be formed such that the side thereof is sloped by using a wet etching method using TMAH or KOH. Namely, preferably, the manifold 210 is formed to have a horizontal section gradually reduced toward a lower portion thereof. This is to enable ink, being introduced through the ink inlet 110, to be easily transferred to the pressure chamber 150 from the manifold 210.

Figure 4F:
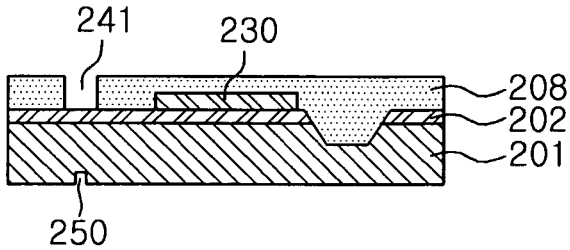

Subsequently, as shown in FIG. 4*f*, a photoresist 208 is applied to the upper surface of the lower board 200 with the projection 230 and the manifold 210 formed thereon, and then patterned to form an opening 241 for forming the damper 240.

Figure 4G:
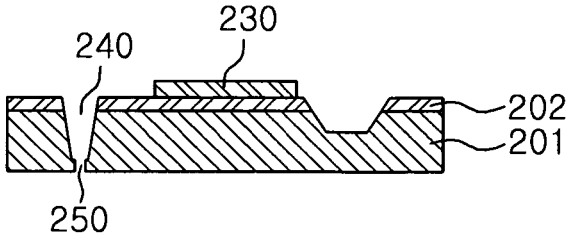

Thereafter, as shown in FIG. 4*g*, portions of the insulating layer 202 and the lower silicon layer 201 are etched by using the patterned photoresist 208 as an etching mask to form the damper 240. In this case, the damper 240 may be formed through a dry etching method or a wet etching method, and may be formed to communicate with the nozzle 250. In this case, the damper 240 may be formed such that the side thereof is sloped according to a wet etching method using TMAH or KOH. Namely, the damper 240 is formed to have a horizontal section diminishing toward a lower portion. This facilitates ink ejection from the pressure chamber 150 to the nozzle 250.

In the present exemplary embodiment, the ink flow path is formed in the order of the nozzle 250, the projection 230, the manifold 210, and the damper 240 on the lower board 200, but this is merely illustrative and the order of the processing steps of the configuration may be changed according to required conditions and design specifications. For example, the projection 230 may first be formed on the lower board 200, and the nozzle, the manifold, and the damper may then be formed in arbitrary order.

The upper board 100 and the lower board 200 having the ink flow path formed therein are bonded to each other, and the piezoelectric actuator 130 is formed at a position corresponding to the position of the pressure chamber 150 on the upper surface of the upper board 100. Then, the inkjet print head according to the present exemplary embodiment is completed.

In this case, preferably, the upper board 100 and the lower board 200 are bonded through silicon direct bonding (SDB). Namely, the lower surface of the first silicon layer 101 of the upper board 100 and the upper surface of the insulating layer 202 of the lower board 200 may be tightly attached as bonding surfaces, and then thermally treated so as to be bonded.

Figure 5:
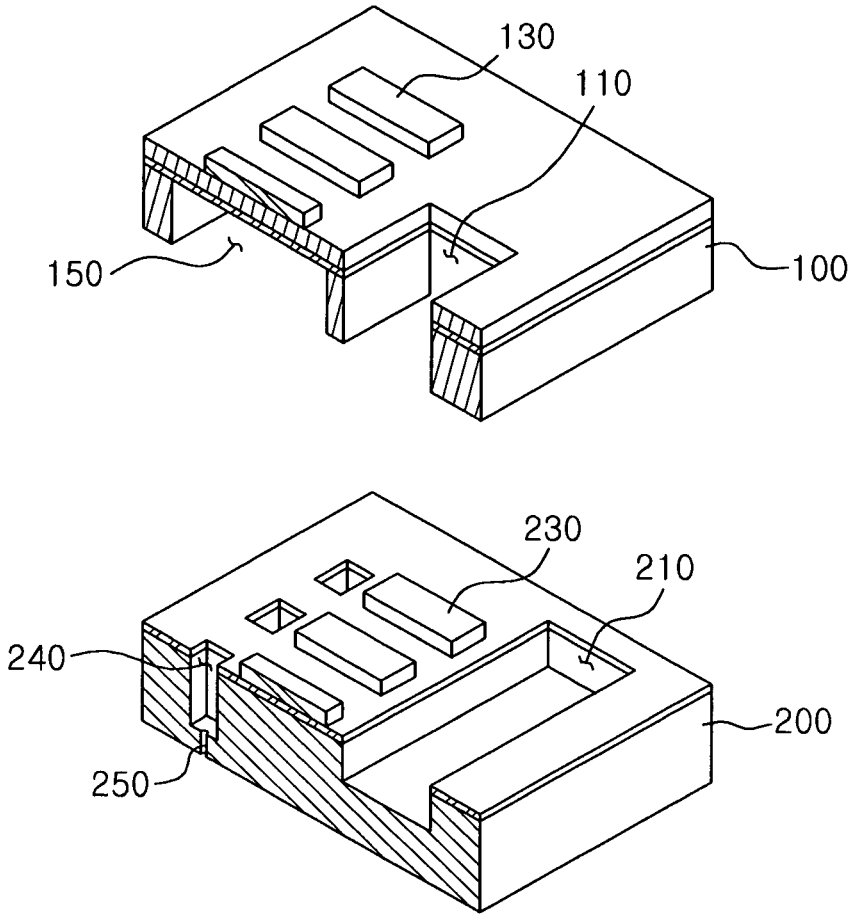
FIG. 5 is an exploded perspective view showing a partially cut inkjet print head according to a second exemplary embodiment of the present invention.
Figure 6:
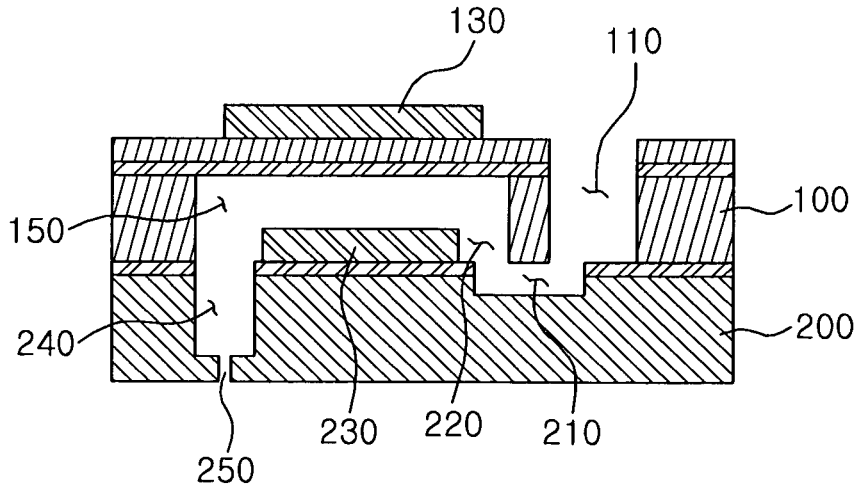
FIG. 6 is a vertical sectional view of the inkjet print head according to the second exemplary embodiment of the present invention.

FIG. 5 is an exploded perspective view showing a partially cut inkjet print head according to a second exemplary embodiment of the present invention. FIG. 6 is a vertical sectional view of the inkjet print head according to the second exemplary embodiment of the present invention. FIGS. 7*a* to 7*h* show a sequential process of a method for forming an ink flow path in a lower board of the inkjet print head according to the second exemplary embodiment of the present invention.

With reference to FIGS. 5 to 7*h*, in the inkjet print head according to the second exemplary embodiment of the present invention, horizontal sections of a manifold and a damper are formed to be equal along a thicknesswise direction of the lower board. Other configurations of the inkjet print head according to the second exemplary embodiment are the same as those of the inkjet print head according to the first exemplary embodiment illustrated in FIG. 1, so a detailed description thereof will be omitted and only differences will be described.

With reference to FIGS. 5 and 6, the inkjet print head according to the second exemplary embodiment of the present invention includes the upper board 100 including the ink inlet 110 and the pressure chamber 150, the lower board 200 including the manifold 210, the projection 230, the damper 240, and the nozzle 250, and the piezoelectric actuator 130 formed on the upper surface of the upper board 100.

The manifold 210 is formed by means of portions of the insulating layer 202 and the lower silicon layer 201 of the lower board 200, and the horizontal section of the manifold 210 is formed to be equal along the thicknesswise direction of the lower board 200. Namely, the side of the manifold 210 is perpendicular to a lower surface of the manifold 210. This may be performed according to a dry etching method such as RIE using ICP.

The damper 240 is formed by means of portions of the insulating layer 202 and the lower silicon layer 201 of the lower board 200 and communicates with the nozzle 250. A horizontal section of the damper 240 is formed to be equal along the thicknesswise direction of the lower board 200.

Namely, the side of the damper 240 is perpendicular to a lower surface of the damper 240. This may be performed according to a dry etching method such as RIE using ICP.

Hereinafter, a method for forming an ink flow path in the lower board of the inkjet print head according to the second exemplary embodiment of the present invention will now be described with reference to FIG. 7. The configuration of the upper board of the inkjet print head according to the second exemplary embodiment of the present invention is the same as that of the inkjet print head according to the first exemplary embodiment of the present invention, so a detailed description thereof will be omitted.

In the method for forming an ink flow path in the lower board of the inkjet print head according to the second exemplary embodiment of the present invention as shown in FIGS. 7*a* to 7*h*, the horizontal sections of the manifold and the damper are formed to be equal in the thicknesswise direction of the lower board, and the steps other than the step of forming the manifold and the step of forming the damper are substantially the same as those of forming the ink flow path in the lower board of the inkjet print head according to the first exemplary embodiment of the present invention illustrated in FIGS. 4*a* to 4*g*. Thus, the steps of forming the manifold and the damper will be described hereinafter.

Figure 7A:
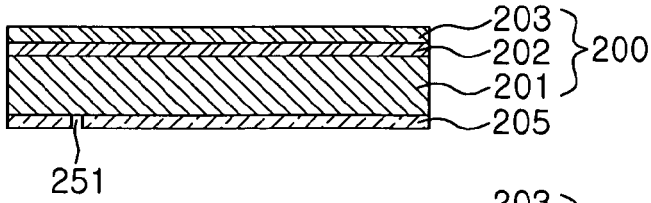
FIGS. 7*a* to 7*h* show a sequential process of a method for forming an ink flow path in a lower board of the inkjet print head according to the second exemplary embodiment of the present invention.

As shown in FIG. 7*a*, the photoresist 205 is applied to a lower surface of the lower board 200 formed by sequentially stacking the lower silicon layer 201, the insulating layer 202, and the upper silicon layer 203, and the applied photoresist 205 is patterned to form the opening 251 for forming the nozzle 250.

Figure 7B:
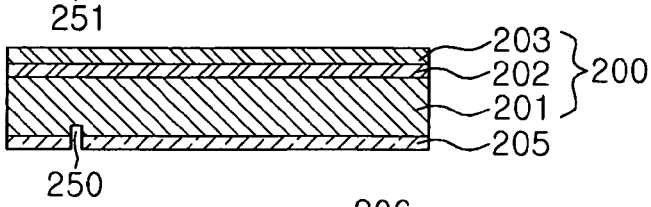

Next, as shown in FIG. 7*b*, a portion of the lower silicon layer 201 exposed through the opening 251 is etched by using the patterned photoresist 205 as an etching mask to form the nozzle 250.

Figure 7C:
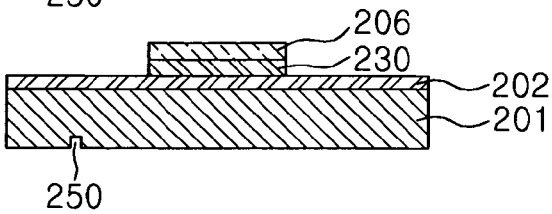

And then, as shown in FIG. 7*c*, a photoresist 206 is applied to an upper surface of the upper silicon layer 203, and portions, excluding a portion for forming the projection 230, of the photoresist 206 are removed, and the exposed portion of the upper silicon layer 203 is etched by using the photoresist 206 as an etching mask to form the projection 230.

Figure 7D:
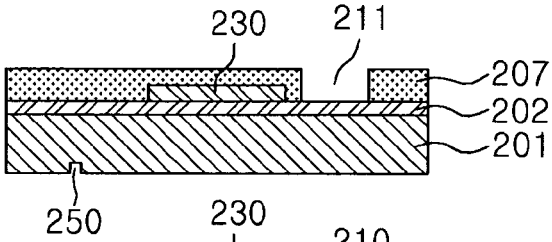

Thereafter, as shown in FIG. 7*d*, a photoresist 207 is applied to cover the upper surface of the lower board 200 with the projection 230 formed thereon, namely, to cover the upper surface of the insulating layer 202 and the upper surface of the projection 230 and patterned to form the opening 211 for forming the manifold 210.

Figure 7E:
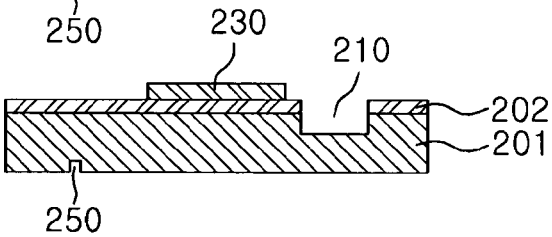

And then, as shown in FIG. 7*e*, portions of the insulating layer 202 and the lower silicon layer 201 are etched by using the patterned photoresist 207 as an etching mask to form the manifold 210. The manifold 210 may be formed through a dry etching method or a wet etching method, and in particular, the manifold 210 may be formed such that the horizontal section thereof is equal along the thicknesswise direction of the lower board 200 through a dry etching method such as RIE using ICP. Namely, the side of the manifold 210 is perpendicular to the lower surface of the manifold 210.

Figure 7F:
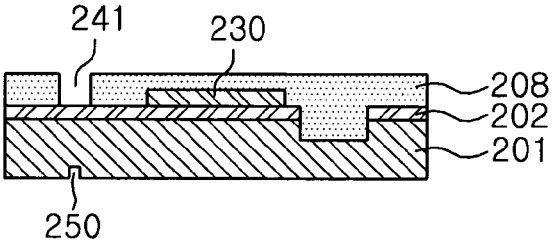

Subsequently, as shown in FIG. 7*f*, a photoresist 208 is applied to the upper surface of the lower board 200 with the projection 230 and the manifold 210 formed thereon, and then patterned to form an opening 241 for forming the damper 240.

Figure 7G:
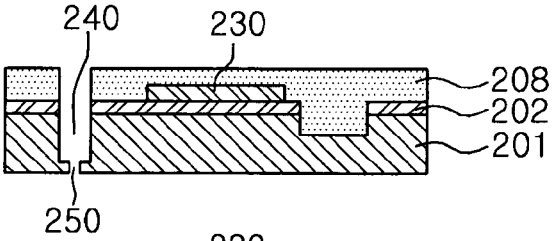

Thereafter, as shown in FIG. 7*g*, portions of the insulating layer 202 and the lower silicon layer 201 are etched by using the patterned photoresist 208 as an etching mask to form the damper 240. In this case, the damper 240 may be formed through a dry etching method of a wet etching method, and in particular, the damper 240 may be formed such that the size of the horizontal section thereof is uniform along the thicknesswise direction of the lower board 200 through a dry etching method such as RIE using ICP. Namely, the side of the damper 240 is perpendicular to the lower surface of the damper 240. In this case, the damper 240 may be formed to communicate with the nozzle 250.

Figure 7H:
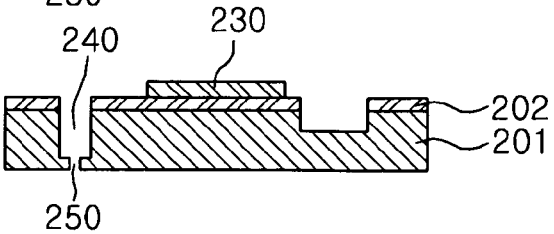

As shown in FIG. 7*h*, when the photoresist 208 formed on the upper surface of the lower board 200 is removed, the lower board 200 is completed. This may be performed through dry etching or wet etching, or may be performed through CMP. In this case, in order to have a desired height of the projection 230 or a desired thickness of the lower board 200, the projection 230 and the lower silicon layer 201 may be partially removed in the thicknesswise direction.

Figure 8:
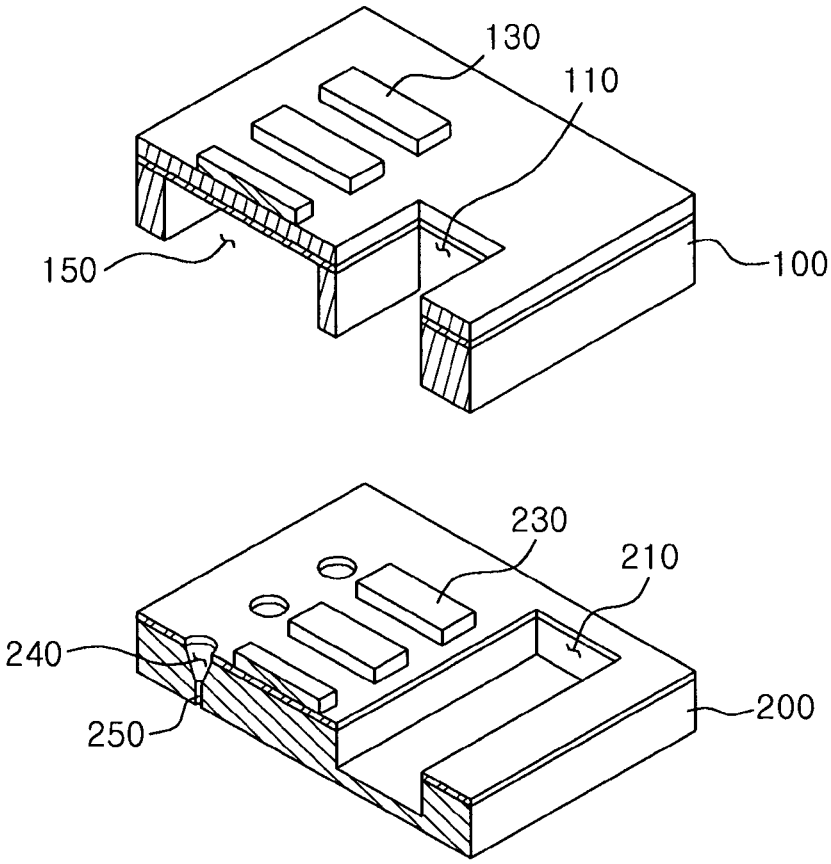
FIG. 8 is an exploded perspective view showing a partially cut inkjet print head according to a third exemplary embodiment of the present invention.
Figure 9:
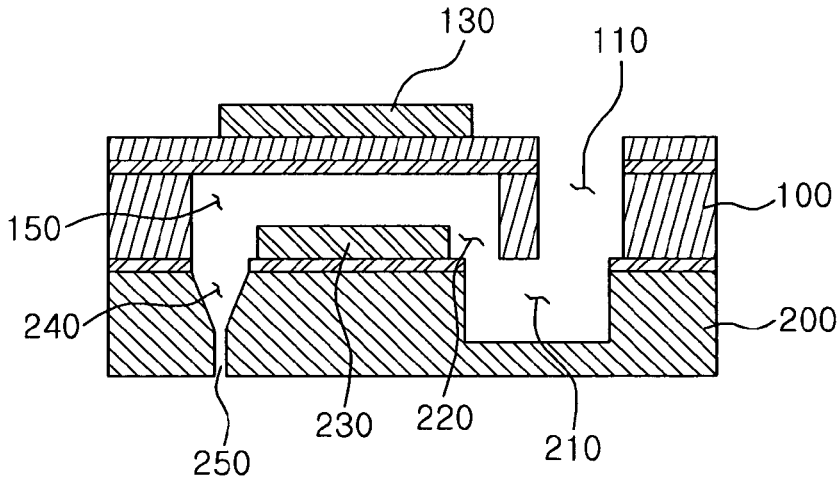
FIG. 9 is a vertical sectional view of the inkjet print head according to the third exemplary embodiment of the present invention.

FIG. 8 is an exploded perspective view showing a partially cut inkjet print head according to a third exemplary embodiment of the present invention. FIG. 9 is a vertical sectional view of the inkjet print head according to the third exemplary embodiment of the present invention. FIGS. 10*a* to 10*i* show a sequential process of a method for forming an ink flow path in a lower board of the inkjet print head according to the third exemplary embodiment of the present invention.

As shown In FIGS. 8 to 10*i*, the inkjet print head according to the third exemplary embodiment of the present invention, a horizontal section of the manifold is formed to be uniform along a thicknesswise direction of the lower board, and a vertical section of the damper is formed to have a inverse trapezoid shape. Other configurations of the inkjet print head according to the third exemplary embodiment are the same as those of the inkjet print head according to the first exemplary embodiment illustrated in FIG. 1, so a detailed description thereof will be omitted and the difference will be described.

With reference to FIGS. 8 and 9, the inkjet print head according to the third exemplary embodiment of the present invention includes the upper board 100 including the ink inlet 110 and the pressure chamber 150, the lower board 200 including the manifold 210, the projection 230, the damper 240, and the nozzle 250, and the piezoelectric actuator 130 formed on the upper surface of the upper board 100.

The manifold 210 according to the present exemplary embodiment is formed by means of portions of the insulating layer 202 and the lower silicon layer 201 of the lower board 200, and the horizontal section of the manifold 210 is formed to be equal along the thicknesswise direction of the lower board 200. Namely, the side of the manifold 210 is perpendicular to a lower surface of the manifold 210.

The damper 240 is formed by means of portions of the insulating layer 202 and the lower silicon layer 201 of the lower board, and a vertical section of the damper 240 has an inverse trapezoid shape. In this case, the lower side of the damper 240 in terms of a vertical section is equal to the diameter of the nozzle 250.

Hereinafter, a method for forming an ink flow path in the lower board of the inkjet print head according to the third exemplary embodiment of the present invention will now be described with reference to FIG. 10. The configuration of the upper board of the inkjet print head according to the third exemplary embodiment of the present invention is the same as that of the inkjet print head according to the first exemplary embodiment of the present invention, so a detailed description thereof will be omitted.

The method for forming an ink flow path in the lower board of the inkjet print head according to the second exemplary embodiment of the present invention as shown in FIGS. 10*a* to 10*i* are different from the steps of forming the ink flow path in the lower board of the inkjet print head according to the first exemplary embodiment of the present invention as shown in FIGS. 4*a* to 4*g* in that after the manifold, the damper and the nozzle are formed in the lower board, the projection is formed, the horizontal section of the manifold is formed to be uniform along the thicknesswise direction of the lower board, and the vertical section of the damper is formed to have an inverse trapezoid shape. The differences will be described in detail as follows.

Figure 10A:
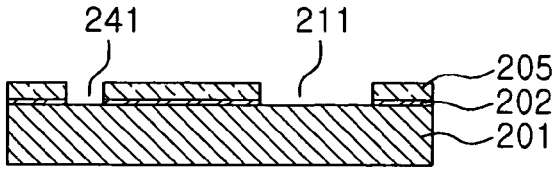
FIGS. 10*a* to 10*i* show a sequential process of a method for forming an ink flow path in a lower board of the inkjet print head according to the third exemplary embodiment of the present invention.

As shown in FIG. 10*a*, the photoresist 205 is applied to an upper portion of the insulating layer 202, the applied photoresist 205 is patterned, and the openings 211 and 214 for forming the manifold 210 and the damper 240 are formed in the insulating layer 202 by using the patterned photoresist 205 as an etching mask.

Figure 10B:
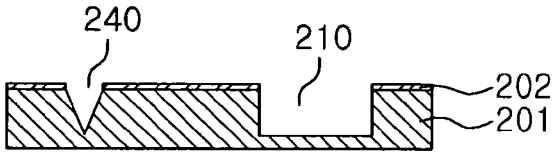

Next, as shown in FIG. 10*b*, a portion of the lower silicon layer 201 exposed through the openings 211 and 241 is etched by using the patterned photoresist 205 as an etching mask to form the manifold 210 and the damper 240 recess.

The manifold 210 may be formed through a dry etching method or a wet etching method, and in particular, the manifold 210 may be formed through a dry etching method such as RIE using ICP such that the horizontal section thereof is equal along the thicknesswise direction of the lower board 200. Namely, the side of the manifold 210 is formed to be perpendicular to the lower surface of the manifold 210.

The damper 240 recess may be formed through a dry etching method or a wet etching method, and in particular, the damper 240 recess can be formed through a wet etching method using TMAH or KOH such that the vertical section thereof has an inverse triangular shape.

Figure 10C:
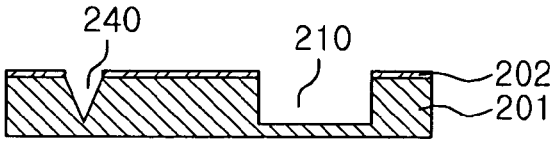

And then, as shown in FIG. 10*c*, the lower silicon layer 201 is polished to have a desired thickness. The lower silicon layer 201 may be polished to have a thickness of approximately hundreds of μm, preferably, a thickness of approximately 210 μm, and may be formed through a CMP process.

Figure 10D:
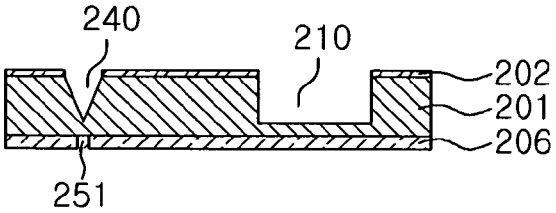

Thereafter, as shown in FIG. 10*d*, the photoresist 206 is applied to the lower surface of the lower silicon layer 201 and patterned to form the opening 251 for forming the nozzle 250.

Figure 10E:
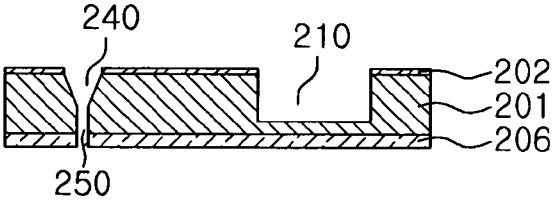

And then, as shown in FIG. 10*e*, a portion of the lower silicon layer 201 is etched by using the patterned photoresist 206 as an etching mask to form the nozzle 250. In this case, the nozzle 250 communicates with the damper 240 having the vertical section in the shape of the inverse trapezoid, and the lower side of the damper 240 in terms of the vertical section may be substantially equal to the diameter of the nozzle 250.

Figure 10F:
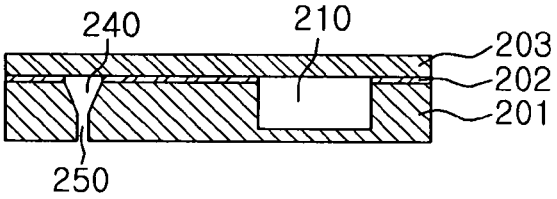

Subsequently, as shown in FIG. 10*f*, the upper silicon layer 203 is formed on the insulating layer 202. The upper silicon layer 203 may be bonded to the insulating layer 202 through an SDB method. In this case, the upper silicon layer 203 may be formed to have the same thickness as that of the projection 230 having a desired thickness through polishing process such as CMP.

Figure 10G:
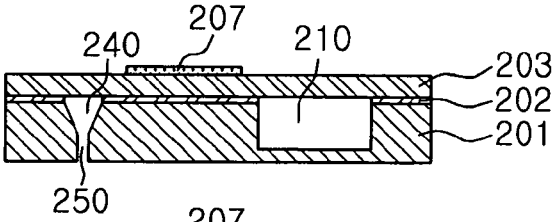

Thereafter, as shown in FIG. 10*g*, the photoresist 207 is applied to the upper portion of the upper silicon layer 203 and patterned to expose portions of the upper silicon layer 203 other than a portion where the projection 230 is to be formed.

Figure 10H:
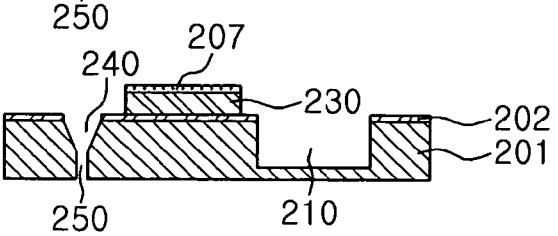

Then, as shown In FIG. 10*h*, the portions of the upper silicon layer 203 other than the portion for the formation of the projection 230 are removed by using the patterned photoresist 207 as an etching mask. As mentioned above, this may be performed through wet etching using TMAH or KOH or dry etching such as RIE using ICP.

Figure 10I:
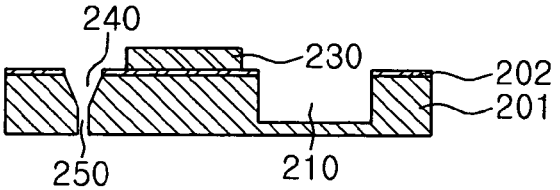

Finally, as shown in FIG. 10*i*, the photoresist 207 formed on the upper surface of the projection 230 is removed to complete the lower board 200.

Figure 11:
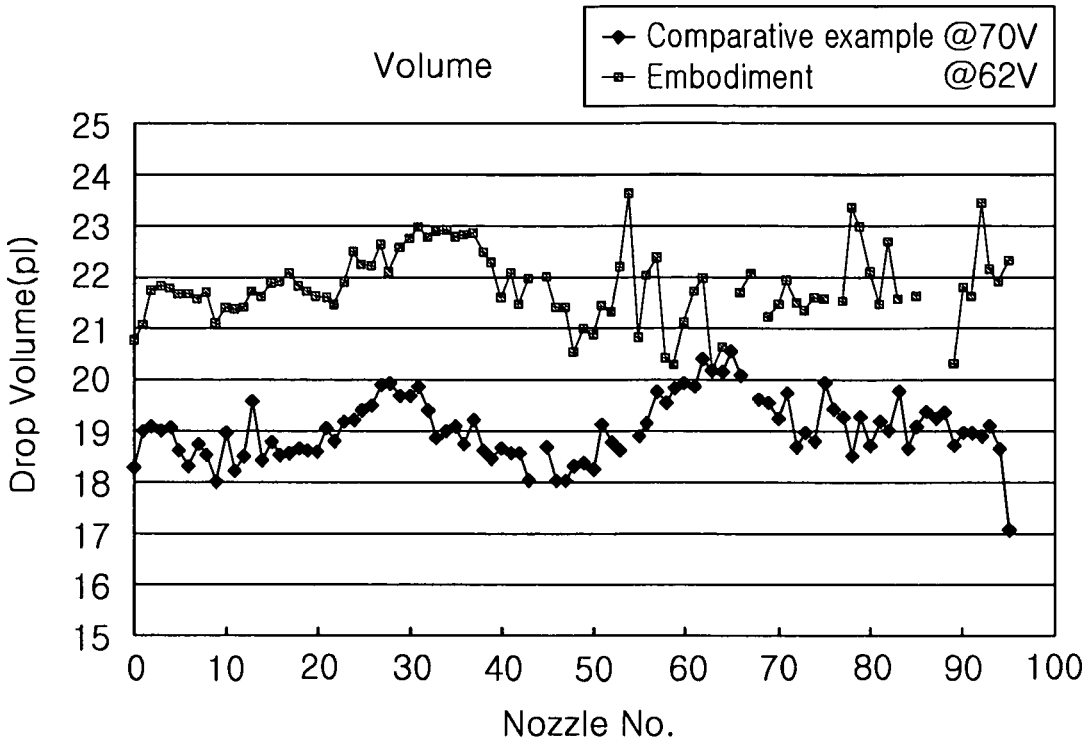
FIG. 11 is a graph showing changes in the droplet ejection volume of the inkjet print head according to an exemplary embodiment of the present invention and that of a comparative example.
Figure 12:
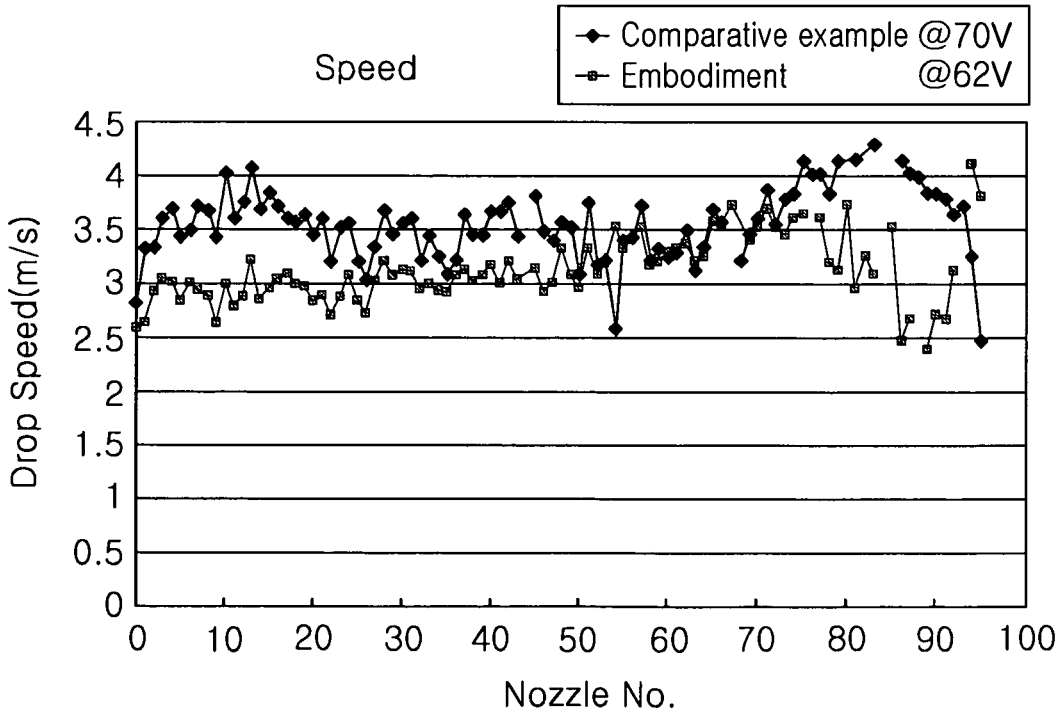
FIG. 12 is a graph showing changes in the droplet ejection speed of the inkjet print head according to an exemplary embodiment of the present invention and that of the comparative example.

FIG. 11 is a graph showing changes in the droplet ejection volume of the inkjet print head according to an exemplary embodiment of the present invention and that of a comparative example. FIG. 12 is a graph showing changes in the droplet ejection speed of the inkjet print head according to an exemplary embodiment of the present invention and that of the comparative example. The inkjet print head according to the Comparative Example has pressure chamber whose space is not reduced, and the height of the pressure chamber of the inkjet print head according to the Embodiment of the present invention is lower than that of Comparative Example.

With reference to the graphs of FIGS. 11 and 12, in case of the inkjet print head according to the Comparative Example, the ejection volume and ejection speed of ink droplets were measured when ink was ejected at a driving voltage of 70V, and in case of the inkjet print head according to the Embodiment of the present invention, the ejection volume and ejection speed of ink droplets were measured when ink was ejected at a driving voltage of 62V.

In the graph of FIG. 11, the ejection volume of the Comparative Example was approximately 19 pl at average, and that of the Embodiment of the present invention was approximately 21.8 pl at average. In the graph of FIG. 12, the average of the ejection speed of the Comparative Example was approximately 3.5 m/s, and that of Embodiment of the present invention was approximately 3.1 m/s.

With reference to the graph of FIG. 11, it is noted that although the driving voltage of the inkjet print head according to the Embodiment of the present invention was lower, the ejection volume was larger. Thus, it would be natural that if the same driving voltage as that of the Comparative Example had been applied to the inkjet print head according to the Embodiment of the present invention, an even larger ejection volume could have been obtained.

Meanwhile, in the graph of FIG. 12, the ejection speed of the inkjet print head according to Embodiment of the present invention is slightly lower than that of the Comparative Example. However, in consideration of the fact that the driving voltage of Comparative Example was higher than that of the Embodiment of the present invention, the difference in the average ejection speeds was 0.4 m/s, which may be considered to be insignificant. Also, in general, the ejection speed of the inkjet print head is sensitive to a driving voltage, so if the same driving voltage, namely 70V, as that of Comparative Example had been applied to the inkjet print head according to Embodiment of the present invention, a higher ejection speed than that of Comparative Example could have been obtained. This can be sufficiently estimated by the fact that the ejection volume was larger in spite of the lower driving voltage.

In this manner, the inkjet print head having excellent ink ejection characteristics such as the ejection speed or ejection volume can be achieved at a lower driving voltage by reducing the space of the pressure chamber to thus reduce the volume of ink to be handled.

As set forth above, according to exemplary embodiments of the invention, because the space in the pressure chamber is reduced by the presence of the projection within the pressure chamber, the driving voltage of the inkjet print head for ejecting ink in droplets at a desired speed or with a desired volume.

In addition, because the lower board is formed of the SOI wafer and the projection is formed of the upper silicon layer of the SOI wafer, the process of manufacturing the ink jet print head can be simplified.

While the present invention has been shown and described in connection with the exemplary embodiments, it will be apparent to those skilled in the art that modifications and variations can be made without departing from the spirit and scope of the invention as defined by the appended claims.

What is claimed is:

1. An inkjet print head comprising:

an upper board having a pressure chamber; and a lower board including an upper silicon layer, an insulating layer, and a lower silicon layer, the lower board comprising a projection formed of the upper silicon layer and protruded into the interior of the pressure chamber in order to reduce the space of the pressure chamber, and portions of the upper silicon layer other than a portion of the projection etched such that the projection is not connected to and is not a part of any remaining upper silicon layer, and a lower surface of the upper board and an upper surface of the insulating layer are fixed.

2. The inkjet print head of claim 1, wherein the upper board is formed of a silicon on insulator (SOI) wafer including a first silicon layer, an intermediate oxide film, and a second silicon layer which are sequentially stacked.

3. The inkjet print head of claim 2, wherein the projection is formed to have a height smaller than the thickness of the first silicon layer.

4. The inkjet print head of claim 1, wherein the lower board comprises:

a manifold supplying ink, being introduced from an ink inlet, to the pressure chamber; and a damper formed between the pressure chamber and a nozzle, wherein the side of at least one of the manifold and the damper is sloped.

5. The inkjet print head of claim 1, wherein the lower board comprises:

a manifold supplying ink, being introduced from an ink inlet, to the pressure chamber; and a damper formed between the pressure chamber and a nozzle, wherein the side of at least one of the manifold and the damper is perpendicular to a lower surface.

6. The inkjet print head of claim 4, wherein a restrictor is formed between the manifold and the pressure chamber in order to prevent ink inside the pressure chamber from flowing backward into the manifold, and the restrictor is formed by the side of the projection near the manifold and by the side of the pressure chamber near the manifold.

7. The inkjet print head of claim 5, wherein a restrictor is formed between the manifold and the pressure chamber in order to prevent ink inside the pressure chamber from flowing backward into the manifold, and the restrictor is formed by the side of the projection near the manifold and by the side of the pressure chamber near the manifold.

8. The inkjet print head of claim 1, wherein the insulating layer is formed of an oxide film formed by oxidizing the surface of the lower silicon layer.

9. A method for manufacturing an inkjet print head, the method comprising:

forming a pressure chamber recess on an upper board;

preparing a lower board by sequentially stacking a lower silicon layer, an insulating layer, and an upper silicon layer;

removing portions of the upper silicon layer other than a portion for forming a projection to be disposed within the pressure chamber recess such that the projection is not connected to and is not a part of any remaining upper silicon layer; and fixing a lower surface of the upper board and an insulating layer of the lower board such that the projection is disposed in a space of the pressure chamber recess.

10. The method of claim 9, wherein the fixing of the lower surface of the upper board and the insulating layer of the lower board is performed through silicon direct bonding (SDB).

11. The method of claim 9, further comprising:

etching the lower board in order to form a manifold supplying ink, being introduced through an ink inlet, to the pressure chamber and a damper, an ink flow path, between the pressure chamber and a nozzle.

12. The method of claim 11, wherein, in etching the lower board, the lower board is etched such that the side of at least one of the manifold and the damper is sloped.

13. The method of claim 11, wherein the etching of the lower board to form the manifold and the damper is performed through reactive ion etching (RIE).

14. The method of claim 9, wherein the removing of the portions of the upper silicon layer other than the portion for forming the projection is performed through RIE using inductively coupled plasma (ICP).

15. The method of claim 9, wherein the removing of the portions of the upper silicon layer other than the portion for forming the projection is performed through a wet etching method using tetramethyl ammonium hydroxide (TMAH) or potassium hydroxide (KOH).

16. The method of claim 9, wherein the removing of the portions of the upper silicon layer other than the portion for forming the projection is performed by using the insulating layer as an etching stopper layer.

17. The method of claim 9, wherein the upper board is formed of a silicon on insulator (SOI) wafer, and the forming of the pressure chamber recess on the upper board is performed by using an intermediate oxide film of the SOI wafer as an etching stopper layer.

18. The method of claim 9, wherein the preparing of the lower board comprises:

etching the lower silicon layer such that a manifold supplying ink, being introduced through the ink inlet, to the pressure chamber and a damper, an ink flow path, between the pressure chamber and the nozzle are formed;

forming the insulating layer on an upper surface of the lower silicon layer; and stacking the upper silicon layer on the insulating layer.

19. The method of claim 18, wherein, in the forming of the insulating layer, the insulating layer is formed by oxidizing the surface of the lower silicon layer.

* * * * *